US005494628A

United States Patent [19]

Beyer et al.

[11] Patent Number: 5,494,628

[45] Date of Patent: Feb. 27, 1996

[54] MAT PRODUCED ON THE BASIS OF A NONWOVEN

[75] Inventors: Friedrich Beyer; Klaus Holzel; Achim Werner, all of Hameln, Germany

[73] Assignee: Vorwerk & Co. Interholding GmbH, Wuppertal, Germany

[21] Appl. No.: 560,492

[22] Filed: Dec. 1, 1993

[30] Foreign Application Priority Data

Dec. 24, 1992 [DE] Germany ..... 42 44 173.0

[51] Int. Cl.[6] ..... B29C 67/00

[52] U.S. Cl. ..... 264/125; 28/100; 241/3

[58] Field of Search ..... 241/3; 28/100; 264/125

[56] References Cited

U.S. PATENT DOCUMENTS

| | | | |
|---|---|---|---|
| 4,268,340 | 5/1981 | Fitzgerald et al. | 156/296 |
| 4,844,765 | 7/1989 | Reith | 156/306.6 |

FOREIGN PATENT DOCUMENTS

| | | |
|---|---|---|
| 669119 | 3/1966 | Belgium . |
| 9100631 | 4/1993 | Belgium . |
| 0005050 | 10/1979 | European Pat. Off. . |
| 0232522 | 8/1987 | European Pat. Off. . |
| 0264588 | 4/1988 | European Pat. Off. . |
| 2253616 | 7/1975 | France . |
| 2016085 | 10/1970 | Germany . |
| 2020761 | 11/1970 | Germany . |
| 2438749 | 2/1976 | Germany . |
| 2722774 | 11/1978 | Germany . |
| 4006766 | 9/1991 | Germany . |
| 1132493 | 11/1968 | United Kingdom . |

OTHER PUBLICATIONS

Database WPI, Week 8550, Derwent Publications Ltd., London, GB; AN 85–314023, & JPA60 219 016(Sekisui Chem. Ind.) 1. Nov. 1985.

Database WPI, Week 8316, Derwent Publications Ltd., London, GB; AN 83–37924K, & JP–A–58 041 910 (Kanebo) 11. Mar. 1993.

Database WPI Week 8530, Derwent Publications Ltd., London, GB; AN 85–181298 (30) & JP–A–60 109 806 (Sekisui Chem Ind KK) 15. J. Uni. 1985.

Chemiefasern/Textilindustrie vol. 43, No. 3, März 1993, Frankfurt/Main, DE Germany pp. 100–101 B. Ten Hoevel 'Aktuelle Teppichtrends'.

Database WPI Week 8548, Derwent Publications Ltd., London, GB; AN 85–299683 (48) & JP–A–60 206 868 (High Seat Kogyo KK) 18 Oktober 1985.

Database WPI Week 8409, Derwent Publications Ltd., London, GB; AN 84–051572 (09) & JP–A–59 009 021 (Hayashi Telemp KK, Jan. 18, 1984.

Moulding resin compsns. with *lower heat distortion temp.* . . Database WPI Week 8903, Derwent Publications Ltd., London, GB; AN 89–019698 & JP–A–63 295 615 (Teijin) 2. Dec. 1988.

Polyethylene naphthalene di:carboxylate polymers for packing food . . . Database WPI Week 8802, Derwent Publications Ltd., London, GB; AN 88–012327 Anonymous & Research Disclosure vol. 284, No. 003, 10. Dec. 1987.

Polystyrene composition–contg finely–powdered polyamide filler . . . Database WPI Week 7407, Derwent Publications Ltd., London, GB; AN 74–12825V & SU–A–374 340 (Tolmacheva et al.) 23. Aug. 1973.

Database *WPI, Section Ch, Week 9346, Derwent Publications Ltd.,* London, GB; Class A95, AN 93–365830 & JP–A–5 272 042 (Ikeda Bussan Co) 19. Oktober 1993.

Data Base Source (C) WIP Derwent AN 85–180267 & JP 60–107309 Jun. 12, 1985 (Ikeda Bussan KK).

*Primary Examiner*—Christopher W. Raimund
*Attorney, Agent, or Firm*—Martin A. Farber

[57] ABSTRACT

A method of producing a nonwoven mat from recycled carpet. The carpet comprises high and low melting thermoplastic fibers. The method comprises shredding the carpet into pieces, scattering the pieces onto a support web to form a layer and heating at least the surface thereof to affect melting of the lower melting thermoplastic fibers.

8 Claims, 4 Drawing Sheets

MAT PRODUCED ON THE BASIS OF A NONWOVEN

FIELD AND BACKGROUND OF THE INVENTION

The present invention relates to a mat produced on basis of a nonwoven.

Such mats are known.

The object of the present invention is to provide a new mat produced on basis of a nonwoven.

SUMMARY OF THE INVENTION

As a result of the development of the invention, there is created a new mat produced on basis of a nonwoven which has a high flexibility produced by the entanglement of low-melting and high-melting parts. The mat of the invention comprises predominantly fibrous plastic parts which are in part thermoplastic and of low melting point and in part of higher melting point. By the superficial melting of the low melting thermoplastic fibers, the fibrous parts are held together. As high-melting fibers polyamide fibers which have a melting point of about 220° C. are preferred. This melting point is clearly above that of the thermoplastic low-melting fibers. Here, polyolefins such as polypropylene, polyethylene or the like are preferred. By the action of heat on the fibers which are strewn of applied loosely in the form of a mat, a superficial melting of the low-melting thermoplastic fibers such as, for instance, polyethylene or polypropylene is obtained, leading to adherence between the low-melting parts and the higher-melting parts. The temperature during the action of the heat corresponds in this connection approximately to the melting point of the low-melting fibers, i.e. about 120°–170° C. In this connection, the stiffness and self-supporting character of the mat can be controlled. For instance, it is increased with an increasing percentage of low-melting thermoplastic fibers within the mat or else upon the lengthy action of heat, whereby the lower lying low-melting fibers are also melted. The mat can furthermore contain portions of polyester fiber material as well as portions of styrene/butadiene, styrene/acrylate or else ethylene vinyl acetate. It has been found particularly advantageous for the melted regions to be arranged in the manner of islands or interlaced as islands. In this way, a netlike support structure of the mat is established, the narrowness of the netting and thus the stiffness and self-supporting character of the mat being dependent on the quantitative ratio between low-melting and high-melting portions and the time of action of the heat. In this connection, it is preferred to arrange the melted regions so that they lie only on the surface. This means that the regions which are melted on the surface of the mat produce coherence together of the fiber portions and thus form a stabilizing "outer skin". The high-melting portions and those low-melting portions not melted by the action of the heat adhere to each other on the one hand due to their entangled condition and, on the other hand, by melting together at the melted regions, to the low-melting portions. In a preferred embodiment, the melted regions are arranged on the surface on one side. The mat thus has a stabilizing "outer skin" only on one side. It is also particularly advantageous for the mat produced as nonwoven to be made conductive, for instance by portions of carbon fibers or metallized conductive fibers (the latter, in their turn, preferably having a base of polyamide).

The object of the invention is, furthermore, a method of manufacturing a mat produced on basis of a nonwoven, for instance a mat of the type described above. In this connection, a carpet consisting predominantly of plastic fibers and which consists preferably of a pile material having a base of preferably polyamide 6,6, preferably of a support material of polypropylene nonwoven or polypropylene ribbon fabric, and furthermore preferably of a precoat of styrene butadiene, ethylene vinyl acetate, styrene acrylate or the like, furthermore preferably of a laminating adhesive having a base of polyolefins such as, for instance, polyolefin and polypropylene, and furthermore preferably of a back layer having a base of polyolefins, preferably polypropylene or the like, is torn into fibrous pieces, a nonwoven, which is possibly needled, is formed therefrom and is acted on, at least the surface of this nonwoven, by heat in such a manner that the low melting thermoplastic portions melt. For this there is required an action of heat which melts the polyolefin parts but not the fibrer portions having a base of in particular polyamide. For example, polyamide has a melting point of 220° C., while the polyolefins used soften and melt already at 120°–170° C. In this way, the low-melting fibers arranged on the surface of the nonwoven are superficially melted, whereby a punctiform bonding of the parts arranged entangled on the surface of the nonwoven is obtained. As already described, the melted regions can be arranged in the form of islands or linked in the form of islands. In order to obtain better adherence of the pieces to each other, it is preferred that the mat be compacted after the melting. In this way, greater stability of the mat is also obtained. It is advantageous to compress the mat between pressing-cooling rolls after the melting. Finally, it is provided that the web be placed on a support web which travels along at least until the low-melting thermoplastic portions have melted. In this way handling is made possible despite coherence of the fibrous parts merely by the entangled position of the individual parts prior to the action of the heat.

In addition to this, the object of the invention is a carpet, in particular a carpet having a pile layer of pile threads, a support layer which consists of fiber or ribbon material of polyolefins or polyesters, and a rear coating, the pile threads being possibly firmly attached to the support layer by the rear coating, and of a plastic which is comparatively resistant to high temperatures, in particular polyamide 6 or 6,6. In this connection, it is intended that an intermediate layer consist of a mat, the mat having fibrous parts which consist predominantly of plastic which are in part thermoplastic and of low melting point and in part of higher melting point, coherence being obtained by the superficial melting of the low-melting thermoplastic fibers, preferably produced in a method in which a carpet consisting predominantly of plastic fibers is torn up into fibrous parts, a nonwoven, possibly a needled woven, is formed therefrom and at least the surface of this nonwoven is acted on by heat in such a manner that low-melting thermoplastic parts melt. The mat described in the previous embodiments can, on the one hand, be used as underlay for tacked carpets or else as intermediate layer within a carpet. In this connection, the mat may be covered on its bottom by a fabric layer. Finally, the mat can advantageously be laminated to an intermediate layer, in particular by the superficial melting of the low-melting thermoplastic parts. In this connection, one can proceed in the manner that the superficial melting of the low-melting thermoplastic parts of the nonwoven form both the coherence between the fibrous parts of the mat and the adherence to an intermediate layer. This can be done in one operation, provided that the parts of the carpet which is to be provided with the mat consist of thermoplastics which are resistant to high temperature.

BRIEF DESCRIPTION OF THE DRAWINGS

The invention is further described below with reference to the accompanying drawings, which, however, show merely illustrative embodiments. In the drawing.

DETAILED DESCRIPTION OF THE PREFERRED EMBODIMENTS

Figure 2:
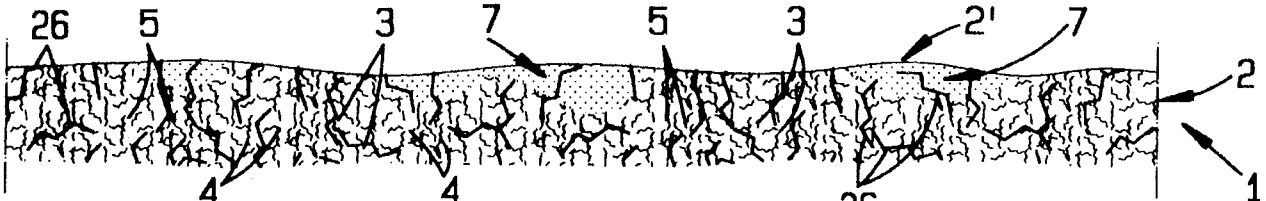
FIG. 2 is a section along the line II—II of FIG. 1.
Figure 1:
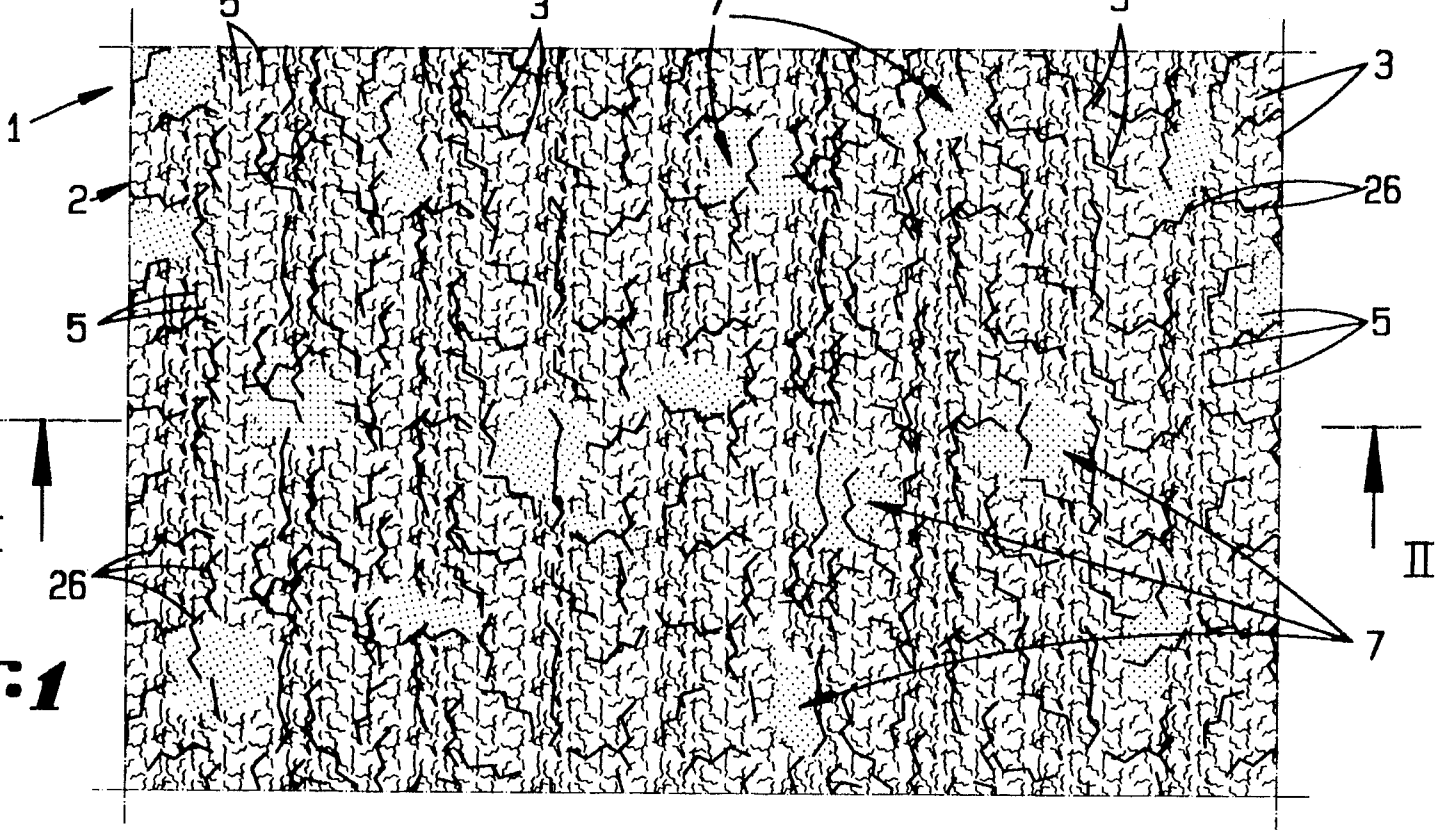
FIG. 1 is a diagrammatic showing of a mat produced on basis of a nonwoven, shown in a greatly enlarged view.
Figure 3:
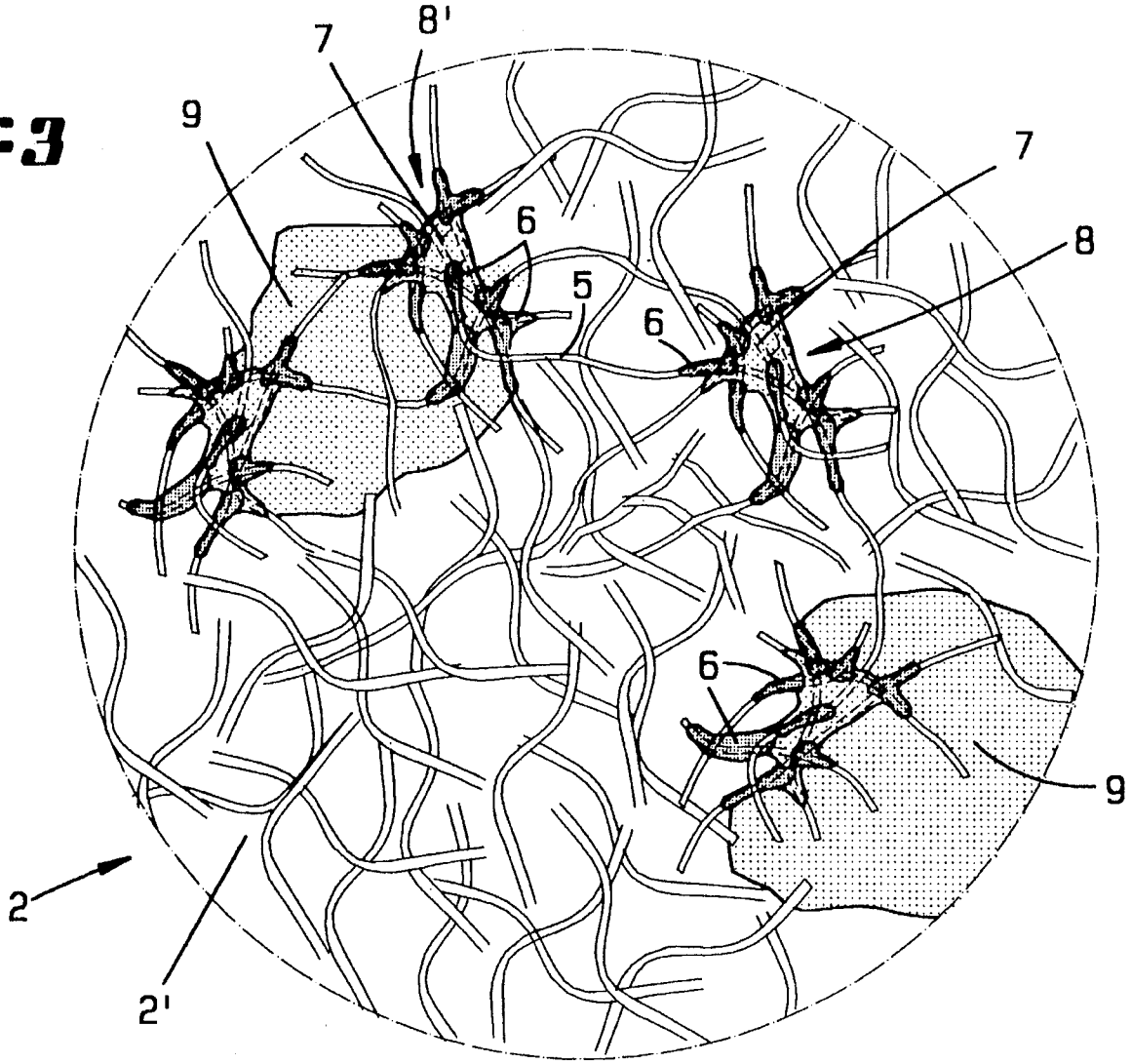
FIG. 3 is a greatly enlarged showing of a portion of FIG. 1 in the region of melted regions of low-melting thermoplastic fibrous parts which are arranged in the form of islands.

Referring to FIG. 1, there is first of all shown and described a mat 2 made on basis of a nonwoven 1 and having fibrous parts 3 consisting predominantly of plastic. These fibrous parts 3 are a mixture of thermoplastic low-melting fibers 4 and higher-melting fibers 5. The low-melting fibers 4 consist, for instance of polyolefins, such as polyethylene, polypropylene, or the like. As fibers 5 which are resistant to high temperature fibers of polyamide 6 or polyamide 6,6 are preferably used. The fibers 4 and 5 are entangled in each other, whereby the fibers 4 and 5 are held together, this holding being increased by regions 7 of melted low-melting fibers arranged distributed on the one surface 2' of the mat 2. As can be noted in particular from FIG. 3, the higher-melting polyamide fibers 5 are connected together by the low-melting fibers 4 which bond the polyamide fibers, surrounding them, as shown, for instance, at the reference numeral 6. Larger accumulations, as indicated by the reference numeral 8, of the thermoplastic portions are also present. Fiber groups 8 which are connected by longer polyamide fibers 5 to other fiber groups 8' result. Furthermore, melted regions 9 in the form of adhesive points on the surface 2' of the mat 2 result. By these adhesive points, which are arranged in the form of islands, improved coherence of the fibers within the mat 2 is obtained. Depending on the frequency of the low-melting fibers 4, these adhesive points can also pass in netlike manner into each other. A support structure is thus established, the adhesive points 9 consisting of melted low-melting fibers 4 partially surrounding the fibers 5 of higher melting point. The latter, in turn, are held together by their entanglement. As can be noted from FIG. 2, only the low-melting fibers 4 which are arranged close to the surface 2' are melted to form adhesive points 9. The low-melting fibers 4 which are remote from the surface 2', i.e. arranged in the center or on the opposite side, are not melted and are included in the entanglement. As a result of the island-like bonding or island-like linked bonding of the fibers 4 and 5 and the entangled position of the fibers, flexibility of the mat 2 is obtained.

In addition to this, the mat 2 contains conductive substances. They may consist, for instance, of carbon fibers 26 or of metallized conductive fibers (the latter, in their turn, having preferably a base of polyamide).

Figure 4:
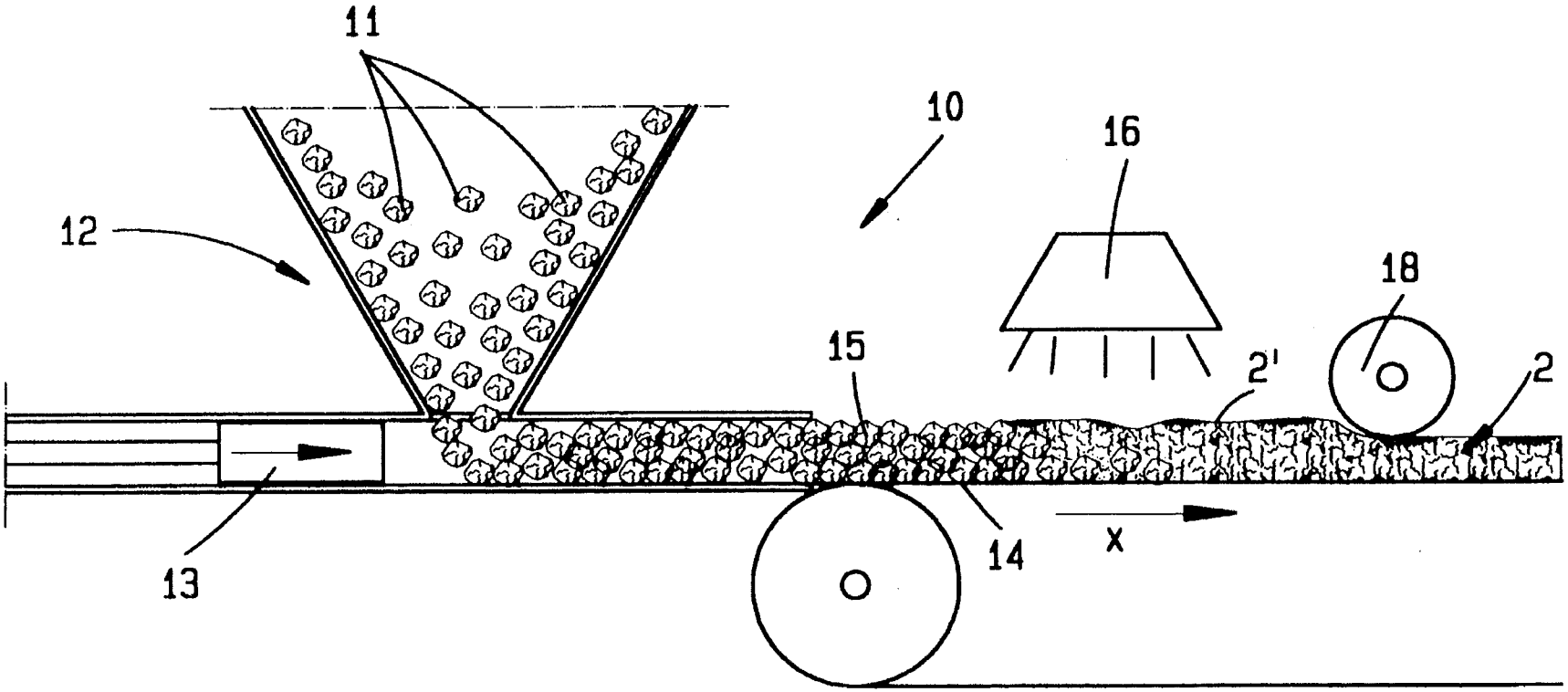
FIG. 4 is a diagrammatic showing of an apparatus for the manufacture of a mat produced on basis of a nonwoven.

In FIG. 4, an apparatus 10 for the manufacture of a mat 2 produced on basis of a nonwoven 1 is shown. For this purpose, fibrous parts 11 which are obtained from a torn carpet consisting predominantly of plastic fibers are shaped in a first apparatus 12 into a loose web held together merely by the entanglement of the individual fibers 4 and 5, for instance by means of a slide 13, and laid on a support web 14 in the form of a circulating endless belt. The nonwoven, which is formed merely by the entanglement of the fibrous parts 3, bears the reference numeral 15 in FIG. 4. The nonwoven lying on the support web 14 now passes below a melting device 16, whereby the low-melting fibers 4 arranged on the surface 2' of the mat 2 are melted and thus form a stabilizing "outer skin". During the further course of the transport after moving below the melting device 16 in the direction indicated by the arrow x, the mat is acted on by pressing-cooling rolls 18 and compacted.

Figure 5:
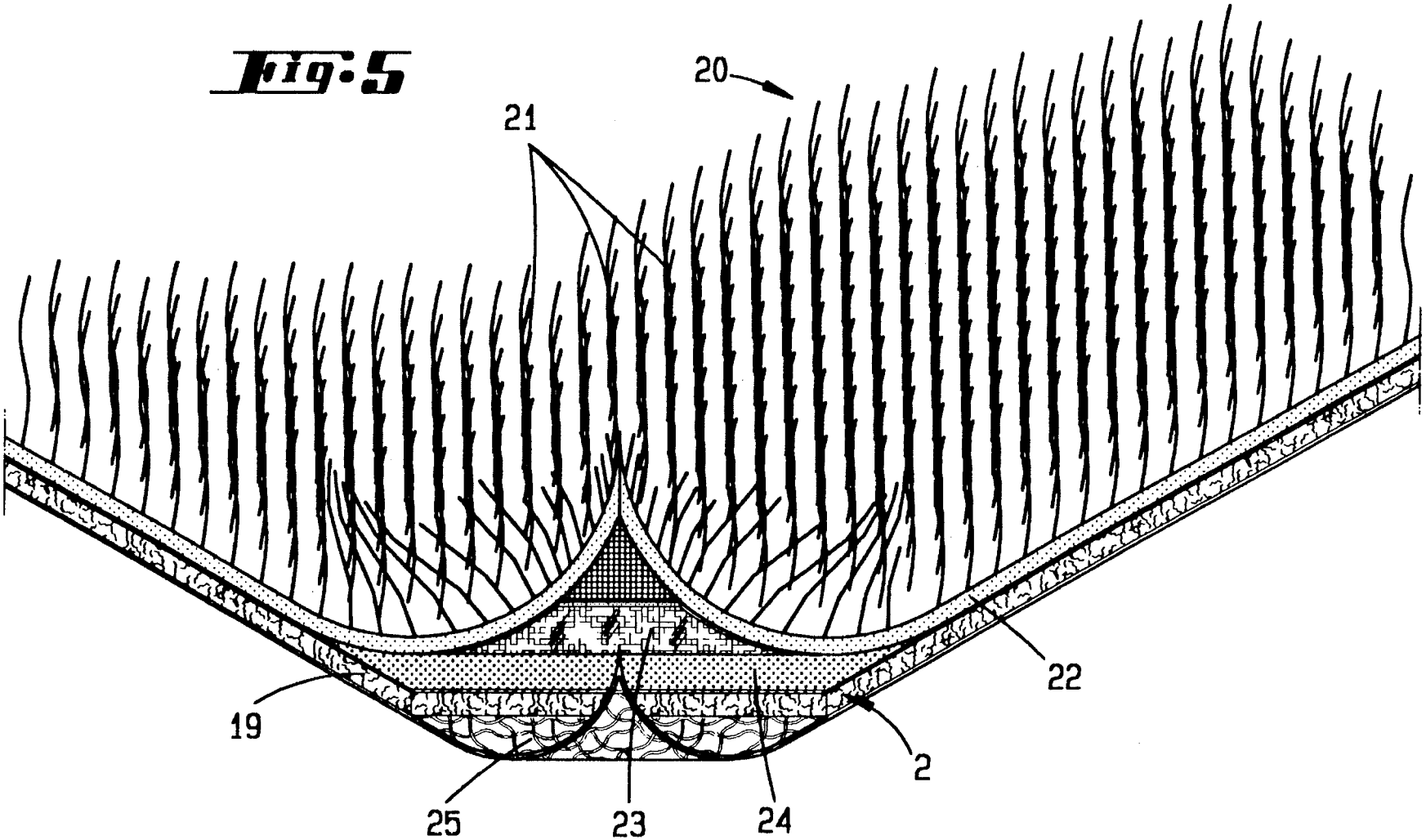
FIG. 5 is a diagrammatic view of a carpet shown partially torn open, the carpet being provided with an intermediate layer consisting of a mat in accordance with FIG. 1.

FIG. 5 shows an example of the uses of a mat 2 produced in this way. In this case, the mat serves as intermediate layer 19 of a carpet 20. This carpet 20, which is shown diagrammatically in FIG. 5, has pile threads 21 which form a pile layer, consisting of polyamide 6 or polyamide 6,6. These pile threads 21 are needled into a support material 22. The support material 22 can be a nonwoven or ribbon fabric of polypropylene. A first attachment of the pile threads 21 to the support material 22 is obtained by a so-called precoat 23, which is shown here as a layer of exaggerated thickness. Actually, the precoat layer is very thin. The precoat consists of copolymers of, for instance, styrene/acrylate, styrene/butadiene, ethylene vinyl acetate, and the like. The support material 22 with the pile threads 21 needled and fastened therein—due, for instance, to the precoat 23—is attached by a lamination 24, shown here also for reasons of demonstration as a layer of exaggerated thickness, to the mat 2, developed as intermediate layer 19. This attachment can, however, also be effected by the melting of the low-melting thermoplastic fibers 4 of the mat 2. On its bottom, the mat is covered by a fabric layer 25. The latter can, for instance, be a fabric having a base of polypropylene.

The mat 2 shown and described can, however, also be used as independent product in the sense of an underlay for tacked carpets.

We claim:

1. A method of producing a nonwoven mat, comprising the steps of providing particulate material of first fibrous parts and of second fibrous parts and of third fibrous parts and of fourth fibrous parts, the first fibrous parts consisting essentially of plastic fibers comprising low-melting point thermoplastic fibers and higher melting point fibers, the second fibrous parts consisting essentially of a carpet pile material, the third fibrous parts consisting essentially of carpet support material of a polypropylene nonwoven or polypropylene ribbon fabric, the fourth fibrous parts consisting essentially of copolymers selected from the group consisting of ethylene vinyl acetate, styrene/butadiene, and styrene/acrylate, the particulate material including also fibrous parts of a laminating adhesive and fibrous parts of a layer having a base of polyolefins;

forming a nonwoven from the particulate material; and melting by subjecting to heat at least a surface of said nonwoven, the heat being applied at a predetermined temperature providing for a melting of the low-melting point thermoplastic fibers without a melting of the higher melting point fibers to obtain the mat.

2. A method of producing a mat according to claim 1, further comprising the steps of compacting the mat after the melting step.

3. A method of producing a mat according to claim 1, further comprising the step of compressing the mat by pressing-cooling rolls after the melting step.

4. A method of producing a mat according to claim 1, wherein the step of forming comprises a step of laying the particulate material on a support web, the method including a further step of allowing the support web to travel with the nonwoven at least until the low-melting point thermoplastic fibers have melted during said melting step.

5. A method of producing a mat according to claim 1, wherein the polyolefins are polypropylene.

6. The method according to claim 1, wherein the pile material has a base of polyamide 6 or polyamide 6,6.

7. A method according to claim 5, wherein said forming step includes a step of laying said carpet pieces on a traveling support web, said web supporting said nonwoven material during said heating step.

8. A method of producing a mat of nonwoven material from a carpet, comprising a step of:

selecting a carpet consisting essentially of plastic fibers which include low melting point thermoplastic fibers and higher melting point fibers, wherein the carpet comprises:

a first component which is a pile material, and a second component which is a support material of a polypropylene nonwoven fabric or a polypropylene ribbon fabric;

a third component which is a precoat of copolymers having a base of copolymers selected from the group consisting essentially of ethylene vinyl acetate, styrene butadiene, and styrene/acrylate; and a fourth component which is a laminating adhesive, and a fifth component which is a backing layer of a base of polyolefins; and wherein said components and said plastic fibers constitute elements;

the method further comprising the steps of:

shredding the carpet into pieces of carpet wherein each of said carpet pieces comprises at least one of said elements;

forming a nonwoven material, said forming step including a step of scattering the carpet pieces form a layer wherein said carpet pieces contact one another; and heating at least a surface of said nonwoven material to a temperature lower than a melting point of said higher melting point fibers but sufficiently high to effect a melting of a plurality of said fibers of said low melting point fibers to attain said mat of nonwoven material.

* * * * *